US005333966A

United States Patent [19]

St-Louis et al.

[11] Patent Number: 5,333,966

[45] Date of Patent: Aug. 2, 1994

[54] SYSTEM FOR PRE-MARKING FOR STREET STRIPING

[75] Inventors: Jonathan P. St-Louis; Kai G. St-Louis, both of Terrebonne, Canada

[73] Assignee: Equipments St-Louis & Fils, Inc., Terrebonne, Canada

[21] Appl. No.: 935,173

[22] Filed: Aug. 26, 1992

[51] Int. Cl.[5] ..... E01C 23/16

[52] U.S. Cl. ..... 404/84.05; 404/94

[58] Field of Search ..... 404/94, 84.5; 362/12, 362/153.1; 33/521, D1-21; 356/356, 358

[56] References Cited

U.S. PATENT DOCUMENTS 4,900,151 2/1990 Ulbers ..... 356/358

5,007,006 4/1991 Taylor et al. ..... 364/571.05

5,052,854 10/1991 Correa et al. ..... 404/94

*Primary Examiner*—Ramon S. Britts

*Assistant Examiner*—Pamela O'Connor

*Attorney, Agent, or Firm*—Cooper & Dunham

[57] ABSTRACT

An apparatus mountable on a vehicle is provided for pre-marking pavement for striping or lining comprising a distance sensor which emits an infrared light beam toward the roadway edge or curb, where it is reflected by a reflector mounted on a stick held by a roadway worker. The reflected light is received by a beam receiver, and the distance of the vehicle from the roadway edge is computed and provided to a marking device, which has a paint gun movable transversely on a carriage guide to position the paint gun a predetermined distance from the roadway edge and mark the pavement in response to the distance measurement.

8 Claims, 1 Drawing Sheet

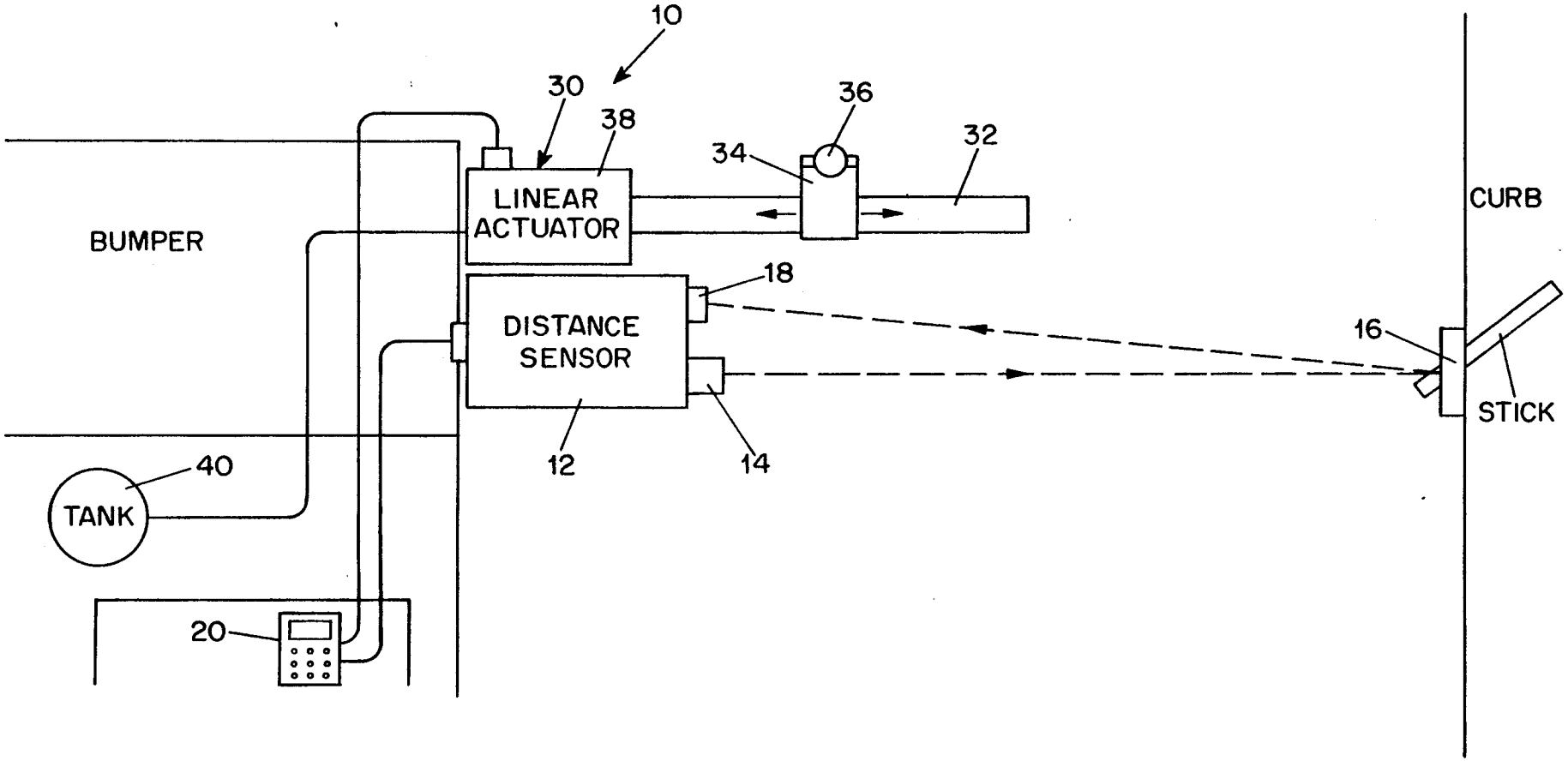
CURB
STICK
16
32
36
34
18
14
10
38
30
LINEAR ACTUATOR
DISTANCE SENSOR
12
BUMPER
40
TANK
20

SYSTEM FOR PRE-MARKING FOR STREET STRIPING

BACKGROUND OF THE INVENTION

The present invention is directed to a system for marking pavement such as streets with marking lines, and is particularly directed to pre-marking pavement with paint guiding marks to later guide a street striping machine.

Painting center line and side line stripes on streets and roads is important for guiding motorists and to reduce the possibility of accidents both by head on collisions and by vehicles colliding with vehicles, persons or other objects along the edge of the roadway. Therefore, many municipalities undertake to paint stripes along the center and edge lines of the roadway.

A major part of the street striping operation is called "pre-marking" which consists of measuring, from the curb or edge of the roadway, the locations at which the longitudinal paint lines are later applied. Most if not all of the pre-marking is done manually. For example, measurements are taken with a tape or string from the edge of the roadway, and paint spots are made on the street using a spray can or similar painting device. The result is not only time-consuming but, more importantly, is especially dangerous. Due to the risk involved, the street workers must be on constant alert to ongoing vehicle traffic while trying to make the appropriate measurements.

SUMMARY OF THE INVENTION

It is one object of the present invention to provide a pre-marking system which would substantially eliminate the need for street workers to be positioned on the street during the pre-marking process.

It is another object of the present invention to provide a pre-marking system which is faster and thus more efficient than the manual street marking processes.

It is a yet further object of the present invention to provide a pre-marking system using substantially less manpower than in the conventional manual pre-marking procedures.

According to one aspect of the invention, an apparatus mountable on a vehicle is provided for marking pavement for striping, comprising distance determining means for determining the distance that a portion of the vehicle is from the edge of a roadway, and marking means responsive to said distance determining means for marking the pavement a predetermined distance from the roadway edge.

BRIEF DESCRIPTION OF THE DRAWING

FIG. 1 is a plan view of a pre-marking system or apparatus according to the present invention.

DETAILED DESCRIPTION OF THE PREFERRED EMBODIMENT

According to the present invention, an apparatus or system for pre-marking pavement for striping is shown in FIG. 1 designated generally by numeral 10. The system comprises a distance sensor 12 mounted to the front bumper or other appropriate location on a vehicle. The distance determining sensor 12 comprises a signal emitter 14, which emits infrared light directed to the edge of a roadway, which may have a curb, where it impinges on reflector 16 mounted at the end of a stick or pole held by a roadway worker. The reflector 16 reflects the infrared light back to receptor 18. Reflectors may be positioned every 5–50 feet, for example. The distance sensor 12 computes, using the time it took for the infrared light to traverse its path, the distance that the distance sensor 12 is from the roadway edge or curb. This information is provided to control box 20 located inside the vehicle cab. The distance sensor 12 may be an infrared sensor available from BML, Ottawa, Canada.

Also mounted to the vehicle is a marking device 30 comprising a marking gun carriage guide 32 and a mobile gun carriage 34 which carries a paint marking gun 36. A linear actuator 38 is responsive to signals from the control box 20 to move the mobile gun carriage 34 toward and away from the roadway edge or curb in response to the signals from the distance sensor 12, and controls the paint marking gun 36 to apply a marking on the roadway a predetermined distance from the roadway edge. The linear actuator 38 carriage and carriage guide may be an "RH series rodless cylinder" available from Industrial Devices, Novato, Calif.

When the device is installed on a particular vehicle, the gun carriage 34 is calibrated to a zero reference point which, e.g., may be about halfway along the carriage guide 32. During use an operator determines the distance that the pre-marks should be made from the roadway edge and inputs this information into the control box 20. The control box 20 then provides appropriate control signals to the linear actuator 38 in response to the distance sensor 12 to position the marking gun 36 at the desired distance.

Suitable means such as a paint tank 40 may be provided for supplying paint to the paint marking gun 36. The system may also comprise means for placing a pre-marking strip down the center of the roadway, or other lane markings by the use of the paint marking device 30 placed on another position of the vehicle, or by providing additional marking devices at other positions of the vehicle.

In cases where it is necessary or desirable to take the distance measurement with reference to the opposite side of the roadway, the distance sensor 12 may be adapted to pivot 180° to direct the beam to a reflector positioned on the opposite side of the roadway. Suitable control means inside the vehicle cab may be used to automatically effect such pivoting. Recalibration of the device should not be necessary, as long as the emitter/-receptor is located at the same position relative to the zero or reference point of the gun carriage 34.

While one preferred embodiment of the invention has been shown and described, numerous variations and modifications will readily occur to those skilled in the art. The present invention is not limited to the preferred embodiment, and its scope is defined only by way of the appended claims.

What is claimed is:

1. Apparatus mountable on a vehicle for marking pavement on a roadway for striping by placing pre-striping marking lines a predetermined distance from the edge of the roadway comprising:

distance determining means for determining the distance that a portion of the vehicle is from the edge of the roadway; and marking means responsive to said distance determining means for marking the pavement a predetermined distance form the roadway edge, comprising means for holding a paint marking gun and means for moving a paint marking gun relative to the vehicle and toward and away from the roadway edge in response to he distance determining means, to locate the paint marking gun a predetermined distance from the roadway edge.

2. Apparatus according to claim 1, wherein the distance determining means comprises:

beam emitting means for emitting a beam toward the roadway edge;

beam reflecting means at the roadway edge for reflecting the beam toward the beam emitting means;

beam receiving means for receiving the reflected beam; and means responsive to the beam receiving means for producing a signal indicative of the distance that the vehicle portion is from the roadway edge.

3. Apparatus according to claim 1, wherein the marking means comprises a marking gun movable toward and away from said roadway edge and means for positioning the marking gun a predetermined distance from the roadway edge.

4. Apparatus according to claim 2, wherein the beam emitting means comprises an infrared beam emitter.

5. Apparatus according to claim 3, wherein the marking means comprises a marking gun carriage guide, a gun carriage movable on said marking gun carriage guide toward and away from said roadway edge, and a paint marking gun mounted on said gun carriage.

6. Apparatus according to claim 1, wherein the distance determining means and the marking means are mounted on the front bumper of the vehicle.

7. Apparatus according to claim 1, wherein the roadway edge has a curb.

8. Apparatus according to claim 2, wherein the beam reflecting means comprises a reflector mounted on a stick.

* * * * *